US005810261A

United States Patent [19]

Winters

[11] Patent Number: 5,810,261

[45] Date of Patent: Sep. 22, 1998

[54] ZERO VELOCITY HEAD WATER NOZZLE

[76] Inventor: George A. Winters, 579 Virginia Dr., Tiburon, Calif. 94920

[21] Appl. No.: 723,054

[22] Filed: Sep. 30, 1996

[51] Int. Cl.[6] ..... B05B 1/34

[52] U.S. Cl. ..... 239/428.5; 239/499; 239/542

[58] Field of Search ..... 239/428.5, 542, 239/499, 524

[56] References Cited

U.S. PATENT DOCUMENTS

| | | | |
|---|---|---|---|
| 1,883,656 | 10/1932 | Estock | 239/542 |
| 2,037,145 | 4/1936 | Palermo | 239/542 |
| 2,224,450 | 12/1940 | Scofield | 239/542 |
| 2,420,958 | 5/1947 | Landreth | 239/542 |
| 2,515,600 | 7/1950 | Hayes | 239/428.5 |
| 2,521,238 | 9/1950 | McCann | 239/542 |
| 2,644,719 | 7/1953 | Thomas | 239/542 |
| 3,058,670 | 10/1962 | Marotto et al. | 239/542 X |
| 3,221,996 | 12/1965 | Emmert | 239/542 |
| 3,430,867 | 3/1969 | Rodgers | 239/542 |
| 4,161,290 | 7/1979 | Hill | 239/396 |

*Primary Examiner*—Lesley D. Morris
*Attorney, Agent, or Firm*—Townsend and Townsend and Crew, LLP

[57] ABSTRACT

A zero velocity head nozzle for effecting aerated discharge of water is disclosed which produces constant maximized zero velocity aerated water flow from a high pressure source. Two hollow, opposed and non-perforate hemispherical chambers are separated by a discharge gap at an equator separating the opposed hemispherical chambers. High pressure water inflow is introduced at the pole of one hemisphere, impacts the opposite pole of the opposed hemisphere, and thereafter sets up a generally toroidal energy dissipating flow path between the opposed hemispherical sections. At the same time, the underside of the hemisphere opposed to the input defines a convenient aeration input to the energy dissipating toroidal flow path. As a direct consequence, water flowing in the toroidal flow path is visibly entrained with miniature bubbles. Outflow of water intermixed with the bubbles occurs at the discharge gap between the opposed hemispherical sections with only a slight upward flow occurring toward the input. This slight upward flow is reversed at flow shield extending over the equatorial discharge gap with the result that zero velocity head discharge occurs with uniform distribution about the discharge gap. As a result, zero velocity head aerated water is conveniently discharged from the nozzle.

7 Claims, 1 Drawing Sheet

ZERO VELOCITY HEAD WATER NOZZLE

This invention relates to water nozzles for receiving water under relatively high pressure and discharging water in an aerated condition with substantially no velocity head or pressure.

BACKGROUND OF THE INVENTION

Water nozzles that receive water under high pressure and discharge water with substantially no velocity upon discharge are known. Such nozzles are commonly used to take water from a high pressure source and deposit the water in volume on plants with an essentially zero velocity head. The deposited water neither damages the plants nor scours the soil around the plants. See for example Estock U.S. Pat. No. 1,883,656 issued Oct. 18, 1932; Palermo U.S. Pat. No. 2,037,145 issued, Apr. 14, 1936; Landreth U.S. Pat. No. 2,420,958 issued May 20, 1947; Scofield U.S. Pat. No. 2,224,450 issued Dec. 10, 1940; Hayes U.S. Pat. No. 2,515,600 issued Jul. 18, 1950; Thomas U.S. Pat. 2,644,719 issued Jul. 7, 1953; Emmert U.S. Pat. No. 3,221,996 issued Dec. 7, 1965; Rodgers U.S. Pat. No. 3,430,867 issued Mar. 4, 1969; Hill U.S. Pat. No. 4,161,290 issued Jul. 17, 1979.

Generally, the water nozzles disclosed in these patents can be divided into two groups. A first group of water nozzles has a series of interconnected chambers with each chamber successively dissipating energy from the water. A second group relates to an essentially continuous interconnected labyrinth of baffles with the water in finding its way through the baffles dissipating energy.

Regarding the series of interconnected chambers, these have most commonly been used by the prior art for the successive dissipation of energy in each chamber. The problem with this approach is two fold. First, when a chamber becomes flooded entirely with water, the energy dissipation characteristics of the chamber are compromised. Since water is an essentially incompressible fluid, the water pressure communicated to the chamber at the inlet, is essentially the same water pressure that is communicated at the outlet. It is to be understood that given enough chambers, water pressure dissipation does eventually occur. In addition, prior art focuses primarily on cylindrical shapes which cannot offer the same flow dynamics provided by the submitted design.

Second, the successive chambers do not conveniently entrain air. Air entrained in water softens the impact of water. Where high volume low velocity water is desired, it is especially desired that air be entrained. As is well known, water with many bubbles within the water is soft on both living plants and does not easily scour or erode soil.

Interconnected baffles forming a labyrinth flow path also have their problems. First, such nozzles are extremely expensive to manufacture. The multiple parts required for each nozzle and the assembly of those multiple parts—usually in close side-by-side relationship is expensive.

Additionally, such interconnected baffles usually require a relatively complex and specialized fitting to effect aeration of water. Frequently, a specialized section of the nozzle is utilized to produce the required inflow of air to the aeration site, and thereafter to intermingle the air with the water to effect the overall aeration desired.

SUMMARY OF THE INVENTION

A zero velocity head nozzle for effecting an aerated discharge of water is disclosed which produces constant maximized zero velocity aerated water flow from a high pressure source. Two hollow, opposed and non-perforate hemispherical chambers are separated by a discharge gap at an equator separating the opposed hemispherical chambers. High pressure water inflow is introduced at the pole of one hemisphere, impacts the opposite pole of the opposed hemisphere, and thereafter sets up a generally toroidal energy dissipating flow path between the opposed hemispherical sections. At the same time, the underside of the hemisphere opposed to the input defines a convenient aeration input to the energy dissipating toroidal flow path. As a direct consequence, water flowing in the toroidal flow path is visibly entrained with miniature bubbles. Outflow of water intermixed with the bubbles occurs at the discharge gap between the opposed hemispherical sections with only a slight upward flow occurring toward the input. For normal discharge water pressures (exceeding about 40 psi), this slight upward flow is reversed at flow shield extending over the equatorial discharge gap with the result that zero velocity head discharge occurs with uniform distribution about the discharge gap. As a result, zero velocity head aerated water is conveniently discharged from the nozzle.

I have experimented with the above design over the prior art. This design generates a constant maximum water flow from any given source and disperses that flow in an aerated water flow evenly from the periphery of the equatorial gap.

Further, the design disclosed herein does not develop a significant back pressure on the water source. As a result, fluid flow is maximized.

An important difference versus prior art is the maximizing of toroidal flow which comes only as a result of a spherically or elliptically shaped chamber as opposed to a cylindrical or other shape. Such a shaped chamber provides a more consistent flow path with minimal scatter and deflection of the water flow. Curvilinear sides to the chamber cause an existing flow from centrifugal flow which cannot happen against the flat walls in a cylindrical or other shaped chamber. Since aerated water travels on the outer periphery of the chamber as a result of toroidal flow, centrifugal force causes an easier, more predictable and more efficient flow of aerated water at the gap in the hemispheres and through the nozzle exit. The balance of unexited flow continues to circulate in its toroidal path until, aerated under pressure from the inflow, it takes its place on the periphery of the chamber and exits with the help of centrifugal force. Maximum efficiency regarding the generation and dispersement of aerated water comes from the elimination, as much as possible, of any solid matter between or connected to the hemispheres, and from allowing the toroidal flow of water to act as the only connecting wall between the hemispheres.

This design incorporates maximum flow result in minimum nozzle size. My new design accomplishes maximum efficiency by (1) accepting a constant, maximum flow of water from a source; (2) minimizing pressure while yet maintaining maximum volume; (3) capturing and dispersing a greater amount of soft, aerated, non-damaging water utilizing the source's highest volume and pressure.

Additionally, the two opposed hemispheres which I utilize provide an efficient flow path occupying minimal volume. I am unaware of systems producing an equivalent "zero pressure drop" with nozzles of lesser volume.

DESCRIPTION OF THE PREFERRED EMBODIMENT

Figure 1:
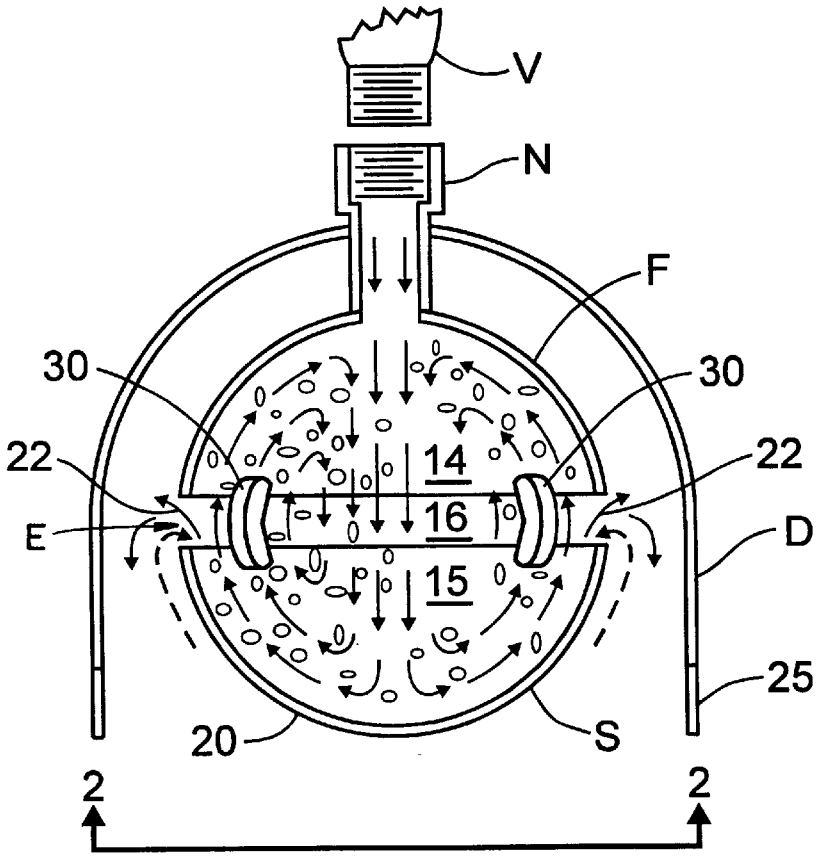
FIG. 1 is a side elevation section of a nozzle constructed according to this invention; and, FIG. 2 is a bottom plan view of the nozzle of FIG. 1 along lines 2—2 of FIG. 1.
Figure 2:
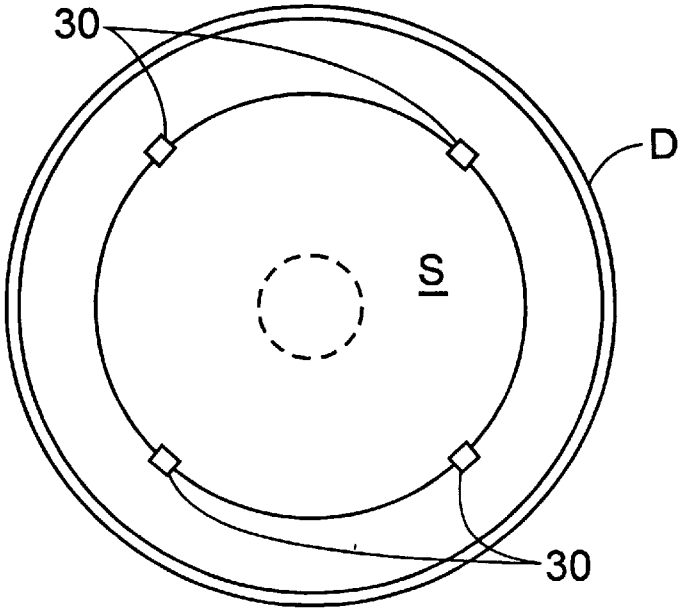

Referring to FIG. 1, first hemisphere F and second hemisphere S are illustrated confronting one another with their respective hollow spherical interior 14 and hollow spherical interior 15 opposed. Hollow spherical interior 14 has nozzle N directed from a "pole" of first hemisphere F towards the opposite "pole" of second hemisphere S. The respective first hemisphere F and second hemisphere S are fastened together so that separation at equator E occurs at gap 16.

Presuming that high pressure, high velocity water (say water exceeding 40+ (the water pressure at my house is 100 psi at the meter) pounds per square inch of pressure is directed from a ¾ inch hose bib) is introduced at nozzle N. This water—which would normally be highly damaging to potted plants and extremely scouring or eroding of any soil contained within or about the potted plants—impacts the opposed sphere at pole 20. At pole 20, water rebounds at the inside periphery of second hemisphere S, in part passes and in part exits through gap 16, and then proceeds to set up a toroidal flow pattern within the hollow defined by first hemisphere F and second hemisphere S. This pattern is illustrated in the drawing and is plainly visible in the operation of the actual device.

Given the pressure range in excess of 40 psi, gap 16 functions to provide a secondary effect. Specifically gap 16 allows air to enter interior of the toroidally flowing water interior of first hemisphere F and second hemisphere S. Observation of the nozzle in operation clearly indicates a thoroughly aerated flow within the toroidal flow pattern.

This aerated flow pattern exits gap 16 with a slightly upward vector 22. This exit has been helped substantially by centrifugal force which can only take place through an opening in a curvilinear sided wall. It is only necessary that this flow vector be deflected downward about second hemisphere S. Accordingly, and attached to first hemisphere F there is downward deflecting shield D. Downward deflecting shield D causes water to fall from gap 16 in a uniform distribution about the circular periphery defined by the opposed spherical sections.

Downward deflecting shield D is here shown as a full hemispherical section—having a size larger than first hemisphere F and depending cylindrical skirt 25. Preferably, depending cylindrical skirt 25 extends a distance below first hemisphere F so that second hemisphere S is completely contained within the depending cylindrical skirt 25.

It will be understood that downward deflecting shield D can only occupy a portion of the region above equatorial gap 16. In this embodiment, downward deflecting shield D would be integrally formed with first hemisphere F. Downward deflecting shield D would protrude from first hemisphere F above gap 16 and depend downward past gap 16. Such dependence would preferably be for the full length needed to completely cover second hemisphere S in its attachment to first hemisphere F.

The manner in which the respective first hemisphere F and second hemisphere S are held across gap 16 can vary. For example, as here illustrated the respective hemispherical sections are held by tensile links 30. Alternately, the respective first hemisphere F and second hemisphere S can be given fastener members which can hold and brace the respective hemispherical sections one to another.

An important feature of this invention is that the disclosed toroidal flow maximizes flow efficiency. As compared to chambers such as cylinders or chambers having baffles interrupting the generated flow pattern, the disclosed toroidal flow path within the curvilinear chamber provides a consistent and uninterrupted flow path.

In observing operation of the device, it has been found that the outside surface of the respective hemispheres tends to be the location to which aerated water naturally collects. This produces a more even and predictable discharge of aerated water at the equatorial gap and through the nozzle exit.

At the same time, water from the interior of the toriodal flow pattern takes the place of water discharged at the equatorial gap. This water become aerated and eventually subjected to discharge.

Regarding the physical connection between the respective hemispheres, experience shows that the size of these fittings should be minimized. This enables more efficient discharge, and more efficient aeration. It is to be noted that the only structural connection required is a tensile connection keeping the two respective hemispheres in their desired spaced apart relation.

I have generally found that the higher the pressure, the better the aeration. For example, I have noted that in systems with approximately 30 psi pressure that relatively little aeration occurs; conversely, in systems with pressure in the range of 100 psi, aeration is present in abundance.

I have used the term "hemispherical." It should be understood that contemplate departure from true spheres. For example, an ellipsoid or an oblate spheroid may do as well. It is however required that the described toroidal flow be preserved, which will be realized as a result of a curvilinear shaped chamber. It will be realized that in the preferred embodiment of this disclosure I use precisely spherical hemispherical sections, these sections being taken from a sphere of the same radius.

It is to be understood that this device can include valve V. While for many purposes, utilizing a hose bib valve can be sufficient, I contemplate utilizing a valve immediate the nozzle of this invention.

What is claimed is:

1. A nozzle for effecting discharge of zero velocity head aerated water comprising in combination:

a first hollow substantially hemispherical section defining half of substantially spherical section;

a second hollow substantially hemispherical section defining a remaining half of a substantially spherical section;

means for mounting the hollow substantially hemispherical sections with an equatorial gap therebetween to define a substantially spherical volume between the hollow substantially hemispherical sections for discharging water and admitting aerating air;

a nozzle for receiving high pressure water flow directed through a pole of the first hollow substantially hemispherical section to an opposed pole of the second hollow substantially hemispherical section for establishing a toroidal flow between the first and second hollow substantially hemispherical sections with discharge of water at the equatorial gap; and, water deflection means for deflecting water from the first hollow substantially hemispherical section toward the second hollow substantially hemispherical section to permit the discharge of zero velocity aerated water.

2. A nozzle for effecting discharge of zero velocity head aerated water according to claim 1 and comprising in further combination:

the water deflection means is separate from the first hemisphere.

3. A nozzle for effecting discharge of zero velocity head aerated water according to claim 1 and comprising in further combination:

the water deflection means depends below said second hemisphere.

4. A nozzle for effecting discharge of zero velocity head aerated water according to claim 1 comprising in further combination:

tensile elements for holding the first hollow substantially hemispherical section to the second hollow substantially hemispherical section.

5. A nozzle for effecting discharge of zero velocity head aerated water according to claim 1 comprising in further combination:

the first hollow substantially hemispherical section and the second hollow substantially hemispherical section are precise sections of a sphere.

6. A nozzle for effecting discharge of zero velocity head aerated water according to claim 1 comprising in further combination:

a valve for controlling water flow is placed immediate to the nozzle.

7. A process of dissipating energy from a high pressure liquid source to produce zero velocity aerated fluid outflow comprising the steps of:

providing a first hollow hemispherical section;

providing a second hollow hemispherical section;

mounting the hemispherical sections with an equatorial gap therebetween for discharging water and admitting aerating air;

receiving high pressure water flow directed through the pole of first hemispherical section to the pole of the second hemispherical section for establishing a toroidal flow between the first and second hemispherical sections with discharge of water at the equatorial gap; and, deflecting water from the first hemispherical section toward the second hemispherical section to permit the discharge of zero velocity aerated water.

* * * * *